US006098730A

United States Patent [19]

Scott et al.

[11] Patent Number: 6,098,730

[45] **Date of Patent: *Aug. 8, 2000**

[54] EARTH-BORING BIT WITH SUPER-HARD CUTTING ELEMENTS

[75] Inventors: Danny E. Scott, Montgomery; Rudolf C. O. Pessier, Houston, both of Tex.; Robert J. Farr, Orem, Utah; Stephen R. Jurewicz, Northridge, Calif.; Kenneth M. Jensen, Springville, Utah; Paul D. Jones, Orem, Utah

[73] Assignee: Baker Hughes Incorporated, Houston, Tex.

[ * ] Notice: This patent is subject to a terminal disclaimer.

[21] Appl. No.: 09/074,260

[22] Filed: May 7, 1998

Related U.S. Application Data

[63] Continuation-in-part of application No. 08/633,983, Apr. 17, 1996.

[51] Int. Cl.[7] ..... E21B 10/46

[52] U.S. Cl. ..... 175/432; 175/434

[58] Field of Search ..... 175/374, 426, 175/432, 434

[56] References Cited

U.S. PATENT DOCUMENTS

| | | |
|---|---|---|
| Re. 32,036 | 11/1985 | Dennis . |
| 3,745,623 | 7/1973 | Wentorf, Jr. et al. . |
| 3,767,371 | 10/1973 | Wentorf, Jr. et al. . |
| 3,841,852 | 10/1974 | Wilder et al. . |
| 3,871,840 | 3/1975 | Wilder et al. . |
| 3,913,280 | 10/1975 | Hall . |
| 4,109,737 | 8/1978 | Bovenkerk . |
| 4,148,368 | 4/1979 | Evans . |
| 4,156,329 | 5/1979 | Daniels et al. . |
| 4,255,165 | 3/1981 | Dennis et al. . |
| 4,268,276 | 5/1981 | Bobenkerk . |
| 4,311,490 | 1/1982 | Bovenkerk et al. . |
| 4,602,691 | 7/1986 | Weaver . |
| 4,604,106 | 8/1986 | Hall et al. . |
| 4,605,343 | 8/1986 | Hibbs, Jr. et al. . |
| 4,629,373 | 12/1986 | Hall . |
| 4,694,918 | 9/1987 | Hall . |
| 4,764,434 | 8/1988 | Aronsson et al. . |
| 4,784,023 | 11/1988 | Dennis . |
| 4,811,801 | 3/1989 | Salesky et al. . |
| 4,913,247 | 4/1990 | Jones . |
| 5,007,207 | 4/1991 | Phaal . |
| 5,016,718 | 5/1991 | Tandberg . |
| 5,120,327 | 6/1992 | Dennis . |
| 5,135,061 | 8/1992 | Newton, Jr. . |

(List continued on next page.)

FOREIGN PATENT DOCUMENTS

| | | |
|---|---|---|
| 0462091A1 | 12/1991 | European Pat. Off. . |
| 2240797 | 8/1991 | United Kingdom . |
| 2290326 | 12/1995 | United Kingdom . |
| 2290327 | 12/1995 | United Kingdom . |
| 2290328 | 12/1995 | United Kingdom . |

OTHER PUBLICATIONS

U.S. application No. 08/803,354, Jensen et al., filed Feb. 20, 1997.

*Primary Examiner*—William Neuder
*Attorney, Agent, or Firm*—Felsman Bradley Vaden Gunter & Dillon, LLP; James E. Bradley

[57] ABSTRACT

An earth-boring bit has a bit body and at least one cantilevered bearing shaft depending inwardly and downwardly from the bit body. A cutter is mounted for rotation on the bearing shaft and includes a plurality of cutting elements. At least one of the cutting elements has a generally cylindrical body formed of hard metal with a convex cutting end. A plurality of substantially recesses are formed on the cutting end of the body. The recesses are configured such that a line parallel to the longitudinal axis of the body may extend from any point of each of the recess without touching any other point on the same recess. This enables the cutting element body and the recess to be formed simultaneously by conventional powder metallurgical techniques. A layer of superhard material is formed on the cutting end of the body and overlays the recesses formed thereon.

22 Claims, 5 Drawing Sheets

U.S. PATENT DOCUMENTS 5,154,245 10/1992 Waldenstrom et al. .
5,158,148 10/1992 Keshavan .
5,217,081 6/1993 Waldenstrom et al. .
5,248,006 9/1993 Scott et al. .
5,264,283 11/1993 Waldenstrom et al. .
5,270,375 12/1993 Yamamoto et al. .
5,273,125 12/1993 Jurewicz .
5,282,512 2/1994 Besson et al. .
5,304,342 4/1994 Hall, Jr. et al. .
5,316,096 5/1994 Good .
5,335,738 8/1994 Waldenstrom et al. .
5,351,772 10/1994 Smith .
5,355,969 10/1994 Hardy et al. .
5,379,854 1/1995 Dennis .
5,436,403 7/1995 Usa .
5,437,343 8/1995 Cooley et al. .
5,443,565 8/1995 Strange, Jr. .
5,460,233 10/1995 Meany et al. .
5,469,927 11/1995 Griffin .
5,472,376 12/1995 Olmstead et al. .
5,486,137 1/1996 Flood et al. .
5,494,477 2/1996 Flood et al. .
5,544,713 8/1996 Dennis .
5,564,511 10/1996 Frushour .
5,566,779 10/1996 Dennis .

EARTH-BORING BIT WITH SUPER-HARD CUTTING ELEMENTS

CROSS-REFERENCE TO RELATED APPLICATION

This application is a continuation-in-part of Ser. No. 08/633,983, filed Apr. 17, 1996.

TECHNICAL FIELD

The present invention relates to improvements in the cutting structure of earth-boring bits. More specifically, the present invention relates to bits having improved super-hard or diamond cutting elements.

BACKGROUND ART

The success of rotary drilling enabled the discovery of deep oil and gas reservoirs. The rotary rock bit was an important invention that made rotary drilling economical.

Only soft earthen formations could be penetrated commercially with the earlier drag bit, but the two-cone rock bit, invented by Howard R. Hughes, U.S. Pat. No. 930,759, drilled the hard caprock at the Spindletop Field near Beaumont, Tex., with relative ease. That venerable invention, within the first decade of this century, could drill a scant fraction of the depth and speed of the modern rotary rock bit. If the original Hughes bit drilled for hours, the modern bit drills for days. Modern bits sometimes drill for thousands of feet instead of merely a few feet. Many advances have contributed to the impressive improvement of rotary rock bits.

In drilling boreholes in earthen formations by the rotary method, rock bits fitted with one, two, or three rolling cutters are employed. The bit is secured to the lower end of a drillstring that is rotated from the surface or by downhole motors or turbines. The cutters mounted on the bit roll and slide upon the bottom of the borehole as the drillstring is rotated, thereby engaging and disintegrating the formation material to be removed. The roller cutters are provided with teeth or cutting elements that are forced to penetrate and gouge the bottom of the borehole by weight from the drillstring. The cuttings from the bottom and sidewalls of the borehole are washed away by drilling fluid that is pumped down from the surface through the hollow, rotating drillstring and are carried in suspension in the drilling fluid to the surface.

It has been a conventional practice for several years to provide diamond or super-hard cutting elements or inserts in earth-boring bits known as PDC, or fixed cutter bits. The excellent hardness, wear, and heat dissipation characteristics of diamond and other super-hard materials are of particular benefit in fixed cutter or drag bits, in which the primary cutting mechanism is scraping. Diamond cutting elements in fixed cutter or drag bits commonly comprise a disk or table of natural or polycrystalline diamond integrally formed on a cemented tungsten carbide or similar hard metal substrate in the form of a stud or cylindrical body that is subsequently brazed or mechanically fit on a bit body. One difficulty encountered with such arrangements is that the diamond table can be separated from its substrate when the interface between the diamond and the substrate is loaded in shear or tension.

One solution to the shearing-off problem has been to contour the interface surface with raised lands, wherein an interface is formed between the substrate and diamond layer that is resistant to shearing and tensile stresses. Examples of this are found in U.S. Pat. No. 4,109,737 to Bovenkerk, U.S. Pat. No. 5,120,327 to Dennis, U.S. Pat. No. 5,351,772 to Smith, and U.S. Pat. No. 5,355,969 to Hardy et al.

Implementation of diamond cutting elements as primary cutting structure in earth-boring bits of the rolling cutter variety has been somewhat less successful than with earth-boring bits of the fixed cutter variety. One reason for this lack of success is that the primary cutting elements of rolling cutter bits are subjected to more complex loadings, depending on their location on the cutters, making separation of the diamond tables from their substrates more likely. Moreover, because the loads encountered by the cutting elements of rolling cutter bits are typically much larger in magnitude than the loads sustained by the cutting elements of fixed cutter bits, stress concentrations caused by prior-art land and groove arrangements at the interface between the diamond and its substrate, such as shown by U.S. Pat. No. 5,379,854 to Dennis, can cause the diamond to crack or fracture.

One solution is found in U.S. Pat. Nos. 4,525,178; 4,504,106; and 4,694,918 to Hall, which disclose cutting elements for a rolling cutter bit having the diamond and substrate formed integrally with a transition layer of a composite of diamond and carbide between the diamond layer and carbide layer. This transition layer is purported to reduce residual stresses between the diamond and carbide because the composite material reduces the differences in mechanical and thermal properties between the diamond and carbide materials. Another solution, disclosed in commonly assigned U.S. Pat. No. 5,119,714 to Scott, is to form a hard metal jacket around a diamond core. Unfortunately, these can be more difficult to manufacture than conventional flat PDC parts and are subject to costly and complex finishing operations.

A need exists, therefore, for diamond cutting elements or inserts for earth-boring bits of the rolling cutter variety that are sufficiently durable to withstand the rugged downhole environment and that are economical in manufacture.

DISCLOSURE OF INVENTION

It is a general object of the present invention to provide an earth-boring bit having improved, super-hard cutting elements.

This and other objects of the invention are achieved by providing an earth-boring bit having a cutter which includes a plurality of cutting elements. At least one of the cutting elements has a generally cylindrical body formed of hard metal with a convex cutting end. A plurality of recesses or grooves are formed on the convex cutting end of the body. The recesses are configured so that no portion of any of the recess has a negative draft angle relative to the longitudinal axis of the cutter. A layer of super-hard material is formed on the cutting end of the body and engages the recesses formed thereon.

According to the preferred embodiment of the present invention, the cutting end is chisel-shaped and defines a pair of flanks converging to define a crest. A pair of ends connect the flanks. The recesses comprises grooves separated by lands which are formed on the flanks substantially parallel to the crest. The layer of super-hard material covers the flanks, crest, and ends of the cutting end. The lands and grooves also may be provided on the ends. According to the preferred embodiment of the present invention, the hard metal is cemented tungsten carbide and the super-hard material is polycrystalline diamond.

The recesses or groves are configured such that a line parallel to the longitudinal axis of the cutting element can extend from any point of the recess without touching any other point of the same recess. Stated another way, the recesses are formed so as to avoid any negative draft angles relative to the longitudinal axis. This enables the recesses to be simultaneously formed while the cutting elements bodies are being formed by a powder metallurgy technique.

The manufacturing technique involves forming recesses as described on a die, pressing metal powder into the die to form a cutting element body, and heating the body in a furnace to sinter the tungsten carbide material. A draft angle of least seven and preferably about ten degrees must be provided so as to allow the body to be removed from the die. Then the polycrystalline diamond will be applied to the recesses. Subsequently, the body is ground to a desired dimension.

A number of embodiments showing recesses of difference contours may be utilized so long as no negative draft angle surfaces are employed. The grooves may have sharp crests and roots or they may be rounded. The flanks of the grooves may intersect each other at an obtuse angle or an acute angle. Moreover, the recesses may comprise separate concave depressions rather than continuous grooves.

The cutting element may have a variety of shapes, such as chisel, hemispherical or conical. In the case of the chisel shape, the body is preferably formed so that the crest of the body from one corner to the other of the cutting end is arcuate. The midpoint of the crest of the body is at a greater distance from the base of the body than the corners of the crest. The super-hard material is coated as a substantially uniform layer on top of the crest of the body. This provides a crest in the final product that is arcuate and requires minimal finishing. The super-hard layer on the remainder of the cutting end will be no thicker than the layer thickness at the crest, and preferably thinner than the layer on the crest. The layer of super-hard material over the contoured grooves will not be uniform in thickness, but the thickest portions will be no thicker than the thickness of the layer at the crest.

BEST MODE FOR CARRYING OUT THE INVENTION

Figure 1:
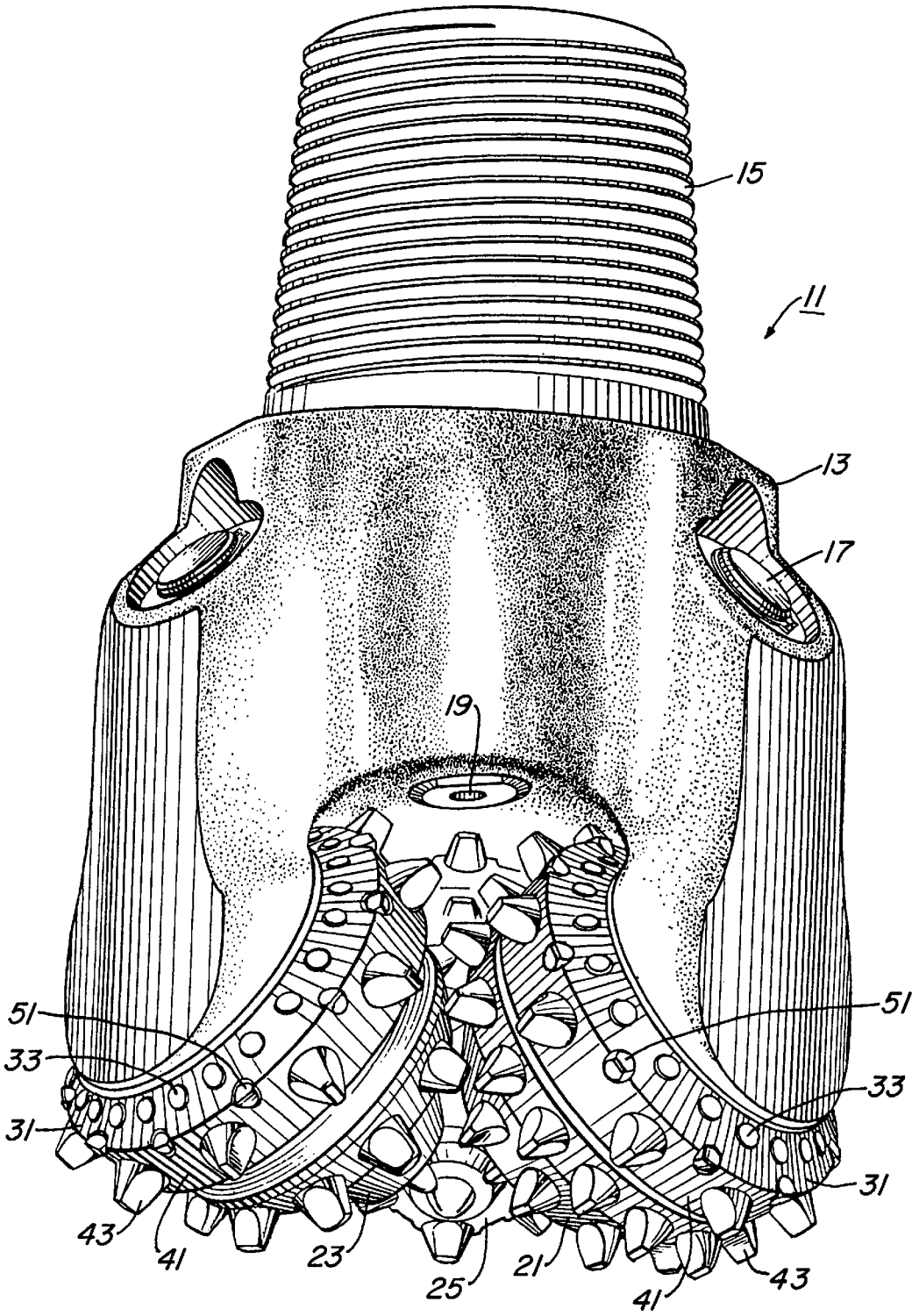
FIG. 1 is a perspective view of an earth-boring bit of the rolling cutter variety according to the present invention.

Referring now to the Figures and particularly to FIG. 1, an earth-boring bit 11 according to the present invention is illustrated. Bit 11 includes a bit body 13, which is threaded at its upper extent 15 for connection into a drill string. Each leg or section of bit 11 is provided with a lubricant compensator 17. At least one nozzle 19 is provided in bit body 13 to spray drilling fluid from within the drillstring to cool and lubricate bit 11 during drilling operation. Three cutters 21, 23, 25 are rotatably secured to a bearing shaft associated with each leg of bit body 13.

Each cutter 21, 23, 25 has a cutter shell surface including a gage surface 31 and a heel surface 41. Each cutter 21, 23, 25 provides a cutter element support for cutting elements. A plurality of cutting elements are arranged in generally circumferential rows on the cutter shell surface. Cutting elements preferably are secured in apertures in the cutters by interference fit and include gage cutting elements 33 on gage surface 31, heel cutting elements 43 on heel surfaces 41, and several inner rows of cutting elements. Gage trimmer or scraper elements 51 are provided generally at the intersection of gage 31 and heel 41 surfaces as disclosed in commonly assigned U.S. Pat. Nos. 5,351,768 and 5,479,997 to Scott et al.

Figure 2:
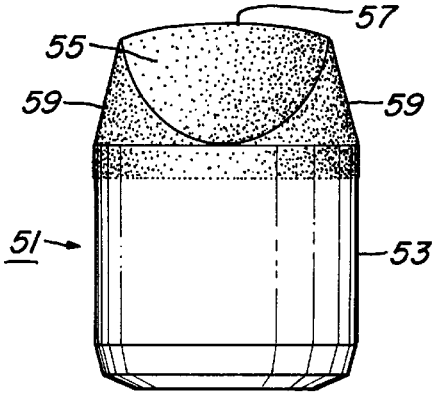
FIG. 2 is an elevation view of the improved cutting element according to the present invention.

FIG. 2 is an elevation view of a cutting element 51 according to the present invention. Although the cutting element illustrated corresponds to a trimmer or scraper insert (51 in FIG. 1), the present invention pertains equally to heel inserts (43 in FIG. 1) and inner row elements. Cutting element 51 comprises a generally cylindrical body 53 formed of hard metal, preferably cemented tungsten carbide. A convex, chisel-shaped cutting end of body 53 has a pair of flanks 55 converging at about 45° to define a crest 57. A pair of ends 59 connect flanks 55 and crest 57 to cylindrical body 53. The cutting end of element 51 is formed of a layer of super-hard material applied over flanks 55, crest 57, and ends 59 of body 53. Super-hard materials include natural diamond, polycrystalline diamond, cubic boron nitride, and other similar materials approaching diamond in hardness and having hardnesses upward of about 3500 to 5000 on the Knoop hardness scale.

Figure 3B:
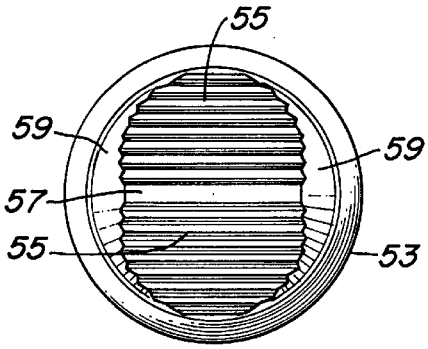
FIGS. 3A–3C are front elevation, plan, and side elevation views, respectively, of the body of the cutting element of FIG. 2.
Figure 3A:
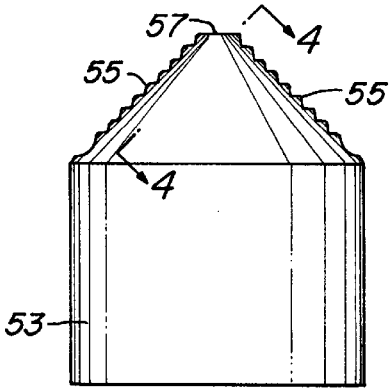
Figure 3C:
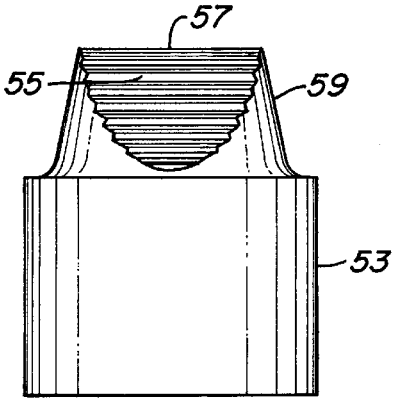

FIGS. 3A–3C are front elevation, plan, and side elevation views, respectively, of cylindrical body 53 prior to the formation of the layer of super-hard material on the cutting end. For ease of reference, the same numerals are used as in FIG. 2, although the super-hard material is not shown formed on the cutting end of body 53. The cutting end of body 53, comprising flanks 55, crests 57, and ends 59, is of a smaller major diameter than body 53 and defines a filleted shoulder to permit application of the layer of super-hard material to result in an element that is continuous and flush in transition from the super-hard material of the cutting end to the hard metal of the cylindrical portion of body 53.

Flanks 55 of the cutting end are provided with a plurality of substantially linear, parallel lands (61 in FIG. 4) that define recesses or grooves (63 in FIG. 4) between the lands. After the layer of super-hard material is formed over flanks 55, crests 57, and ends 59 of the cutting end of body 53, the super-hard material engages lands 61 and grooves 63 to provide an interlocking interface between the hard metal and the super-hard material that is resistant to shear and tensile stresses acting between the super-hard and hard metal. After the super-hard material has been applied, insert 51 will be ground to the size and configuration shown in FIG. 2. Body 53 and at least a portion of the super-hard material on the cutting end immediately adjacent body 53 will be ground. Additional contours may be ground or finished.

Figure 4:
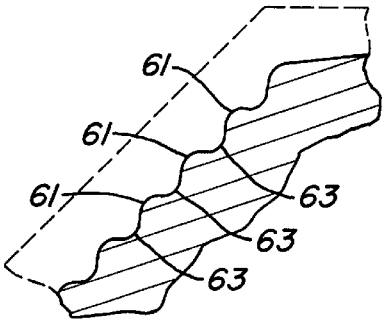
FIG. 4 is an enlarged sectional view of a portion of the body of the cutting element of FIGS. 3A–3C.

FIG. 4 is an enlarged view of a portion of a flank (55 in FIGS. 3A–3C) of the cutting end of body 53. Lands 61 have flat or rectilinear top surfaces and grooves 63 have arcuate bottom surfaces. In this embodiment, to avoid stress concentrations at the interface, the intersections of lands 61 and grooves 63 define oblique angles rather than right or acute angles. The bottoms of grooves 63 are generally circular radii. The top and bottom surfaces of lands 61 and grooves 63 are thus free of sharp corners and the like to reduce stress concentrations in the interface between the super-hard material (shown in phantom) and the hard metal body, thereby reducing the likelihood of cracking or fracturing of the super-hard material.

As shown in FIG. 4, lands 61 preferably are 0.008 inch wide and are spaced-apart 0.035 inch center-to-center. Grooves 63 are 0.007 inch deep and have a radius of 0.012 inch. The angle included between adjacent land 61 intersections with each groove 63 preferably is 90°, which permits lands 61 and grooves 63 to be formed integrally into the cutting end of body 53 by conventional powder metallurgy processing techniques, eliminating the need for machining or grinding operations to form lands 61 and grooves 63. Further assisting the integral formation of grooves 63 is that the ascending (upwardly curving toward crest 57) portions of each groove are provided with a positive draft angle of at least 7 degrees and preferably 10 from vertical (all dimensions given are nominal).

Figure 6:
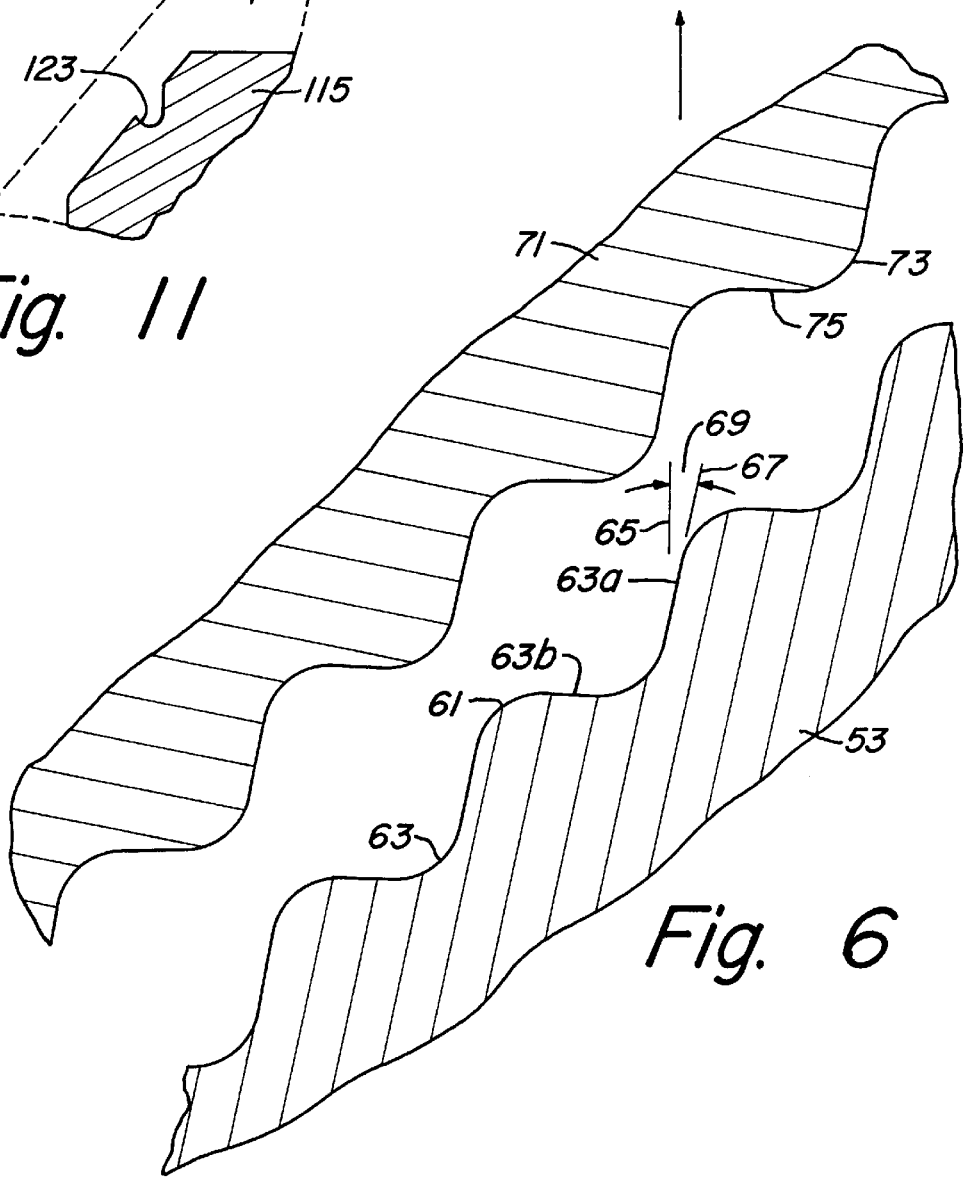
FIG. 6 is an enlarged partial sectional view of the portion of the body shown in FIG. 4, and also showing a portion of a forming die.

FIG. 6 is an enlarged view of FIG. 4. The grooves or roots 63 each have an upper slope portion 63*a* and a lower slope portion 63*b*. The terms "upper" and "lower" are used herein for convenience, with "upper" being the direction toward crest 57. Both slopes 63*a*, 63*b* have substantially flat portions between the crests or lands 61 and the roots or grooves 63. No portion of either the lands 61 nor roots 63 is formed at a negative draft angle relative to longitudinal axis 65. For example, note tangent line 67, which is tangent to a point on upper slope 63*a* and which extends in an ascending direction toward crest 57. Tangent line 67 forms a draft angle 69 relative to longitudinal axis 65 that is positive when measured clockwise from axis 65. If tangent line 67 were located in a counterclockwise direction from axis 65, creating an overhanging portion of upper slope 63*a*, then it would be a negative draft angle. An overhanging portion would prevent manufacturing in the preferred method. The preferred positive draft angle 69 at any point on grooves 63 is at least 7 degrees and preferably 10 degrees.

In the preferred method, a die 71 will have lands 73 and grooves 75 formed therein. Powered metal, preferably tungsten carbide, will be packed tightly within die 71. Then, body 53 will be removed from die 71 and sintered in a furnace as pressed. In order to allow removal, there must be a draft in die 71 that allows it to separate from the contours 61, 63. If there were a negative draft angle, causing by an overhanging portion, die 71 could not be moved upward relative to body 53 in a longitudinal direction. It would be prevented from doing so by the overhang. Consequently, the surfaces making up grooves 63 and lands 61 must be contoured so that a line could extend from any point on these surfaces parallel with axis 65 and not intersect any other point on the grooves 63, such as would occur if there were an overhanging portion.

Figure 5:
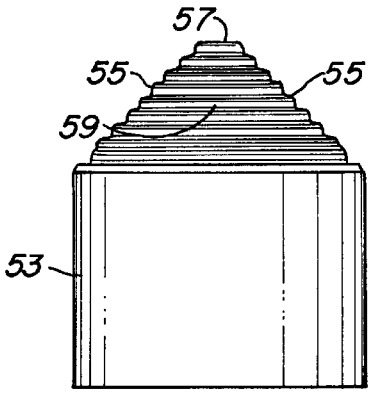
FIG. 5 is an elevation view, similar to FIG. 3A, of a first alternative embodiment of the present invention.

FIG. 5 is an elevation view, similar to FIG. 3A, of an alternative embodiment of the present invention in which lands and grooves are formed in ends 59 as well as on flanks 55 of the cutting end of body 53. As with lands 61 and grooves 63 in FIG. 4, the lands and grooves are substantially linear (although curved along the contour of ends 59) and parallel to crest 57 and are formed to avoid stress concentrations in the layer of super-hard material.

Hard metal body 53 of cutting element 51 is formed using conventional powder metallurgy techniques. The polycrystalline diamond super-hard layer is formed using high-pressure, high-temperature processes such as those disclosed in U.S. Pat. Nos. 3,745,623 and 3,913,280.

Figure 7:
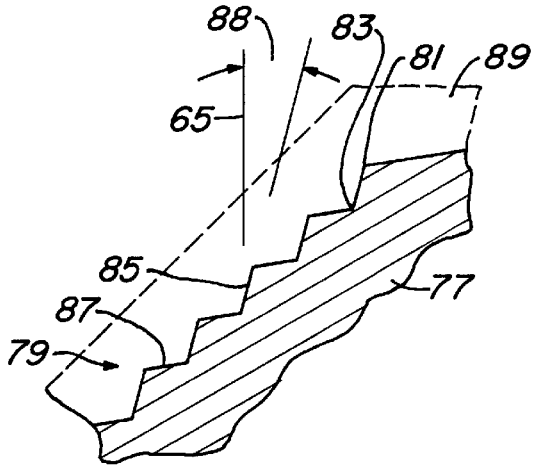
FIG. 7 is an enlarged sectional view of a portion of the body of a second alternative embodiment of a cutting element in accordance with the present invention.

Recesses of different configurations than in the first two embodiments may be employed. In FIG. 7, body 77 has grooves 79 which are generally in a saw-tooth or triangular configuration. Each of the grooves 71 has crest 81 and a root 83. The upper flank or slope 85 and the lower flank or slope 87 are flat and form an angle relative to each other that is obtuse. Upper flank 85 is formed at a draft angle 88 relative to axis 65 that is positive, at least 7 degrees and preferably 10 degrees. As explained above, this allows separation of the die during the manufacturing process. Subsequently, super-hard material 89 will be placed over grooves 79 as described above.

Figure 8:
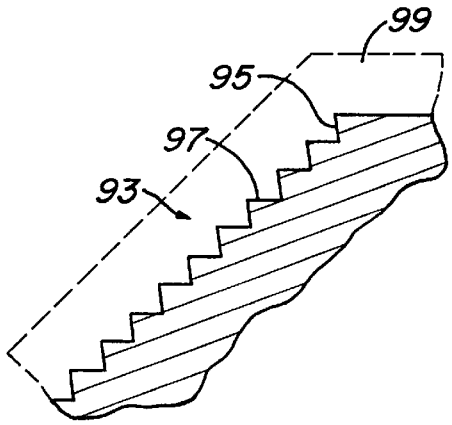
FIG. 8 is an enlarged sectional view of a portion of the body of a third alternative embodiment of a cutting element in accordance with the present invention.

In FIG. 8, the configuration of grooves 93 is also triangular or saw-tooth. Upper flanks 95 intersect lower flanks 97, however, at an acute angle slightly less than 90°. Upper flanks 95 will have a positive draft angle in the same manner as FIG. 7. Super-hard material 99 will be overlaid on grooves 93 in the same manner as previously described.

Figure 9:
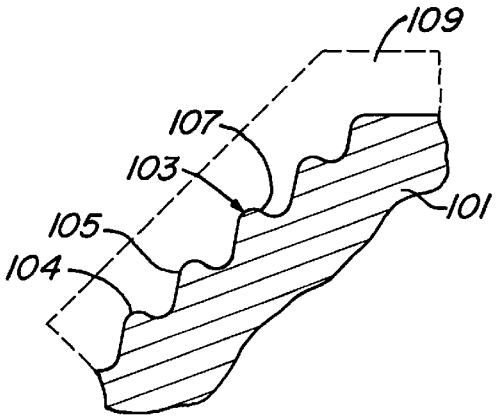
FIG. 9 is an enlarged sectional view of a portion of the body of a fourth alternative embodiment of a cutting element in accordance with the present invention.

In FIG. 9, body 101 has grooves 103 that form continuous curves with crests 104. There are no flat portions on the grooves 103 or crests 104. Upper slopes 105 are curved as well as lower slopes 107, forming rounded crests 104 and roots 103. A tangent line to each point on upper slope 105 will form a positive draft angle. Lower slopes 107 may be more concave than upper slopes 105 and need not be symmetrical to upper slopes 105. Super-hard material 109 will be overlaid on recesses 103 in the same manner as previously described.

Figure 10A:
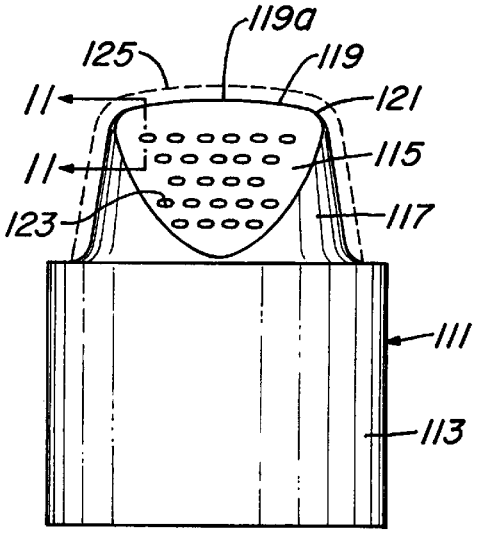
FIG. 10A is an elevation view of a fifth alternative embodiment of the present invention.
Figure 10B:
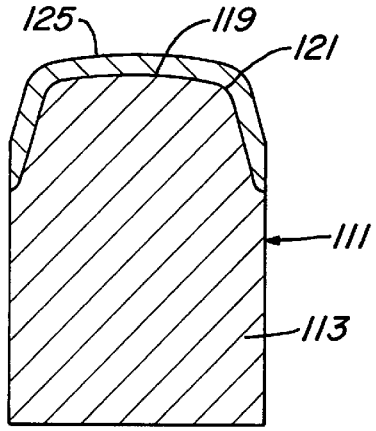
FIG. 10B is a longitudinal sectional view of the embodiment of FIG. 10A.

In the embodiment of FIGS. 10A and 10B, body 111 has a cylindrical base 113, two flanks 115 (only one shown), and ends 117 that join flanks 115. Flanks 115 and ends 117 converge to form an elongated crest 119, with rounded corners 121 at each of the ends 117. Between corners 121, crest 119 is not a straight line perpendicular to the longitudinal axis as shown in FIG. 3C, rather it is arcuate. A mid-point 119*a* of crest 119 will be at a greater distance from the base 113 than corners 121.

Figure 11:
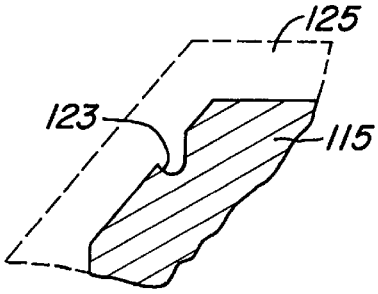
FIG. 11 is a sectional view of the embodiment of FIG. 10A, taken along the line 11—11 of FIG. 10A.

Another difference is that rather than linear recesses as shown in the other embodiments, the recesses may comprise separate individual depressions 123 formed on flanks 115. As shown in FIG. 11, each depression 123 is concave and configured so that its upper slope will be at a positive draft angle as previously described. Super-hard material 125 overlays the entire cutting end 117. As shown in FIG. 10B, super-hard material 125 is of uniform thickness over crest 119, producing an arcuate crest with rounded corners on super-hard material 125. Arcuate crests 119 as in FIG. 10B may be employed in the other embodiments as well. In this embodiment as well as the others, preferably, the thickness of the super-hard material 125 on the portions of the cutting tip other than crest 119 will not be any thicker than on crest 119. The thickness of the layer of super-hard material 125 tapers in a downward direction and becomes gradually thinner as it approaches base 113. In FIG. 10B, body 111, along with a portion of super-hard material 125, has been ground to size, while FIG. 10A shows body 111 prior to grinding.

Figure 12:
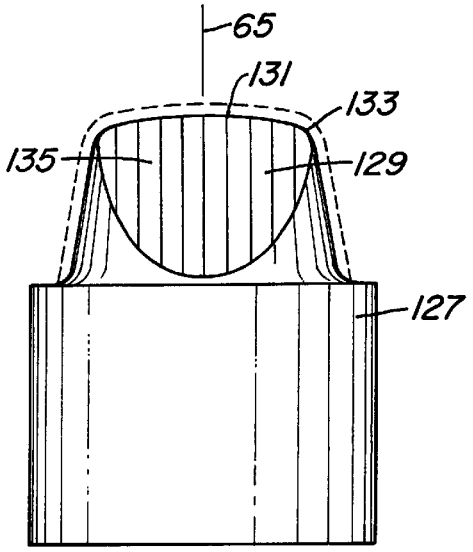
FIG. 12 is an elevation view of a sixth alternative embodiment of the present invention.

FIG. 12 shows a cutting element body 127 which is also a chisel type having flanks 129 which converge to a crest 131. A corner 133 is located at each end of crest 131. Crest 131 forms a curved line between rounded corners 133, as in FIG. 10B. The recesses comprise grooves 135 which extend generally parallel with axis 65. Recesses 135 may be of any of the types shown in FIGS. 4–9, with one difference. In FIGS. 4–9, the various lands and grooves extend perpendicular to longitudinal axis 65, rather than parallel to axis 65.

Figure 13:
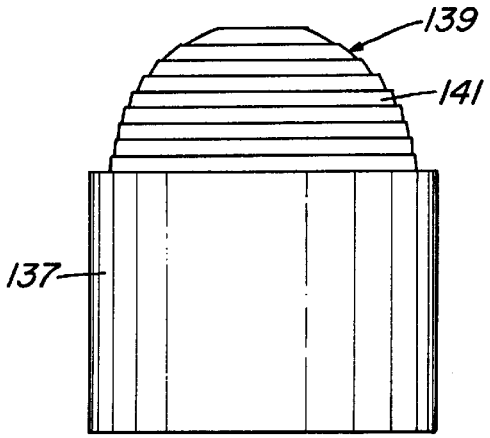
FIG. 13 is an elevation view of a seventh alternative embodiment of the present invention.
Figure 14:
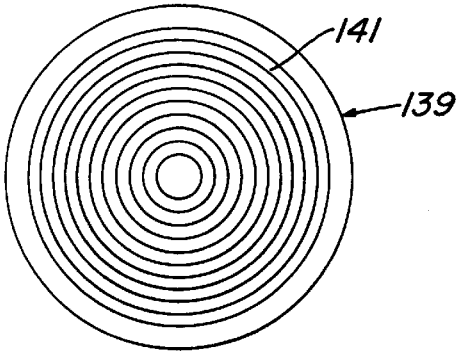
FIG. 14 is a top view of the embodiment of FIG. 12.

Referring to FIG. 13, body 137 has a hemispherical cutting end 139. Grooves 141 extend in a circular pattern around cutting end 139 as shown in FIG. 14. Grooves 141 may be any one of the types shown in FIGS. 4–9. Moreover, individual depressions such as recesses 123 in FIG. 10A could be utilized. As shown in FIG. 14, the recesses will extend around the entire surface. If grooves such as those shown in FIGS. 4–9 are employed, the grooves will be circular.

Figure 15:
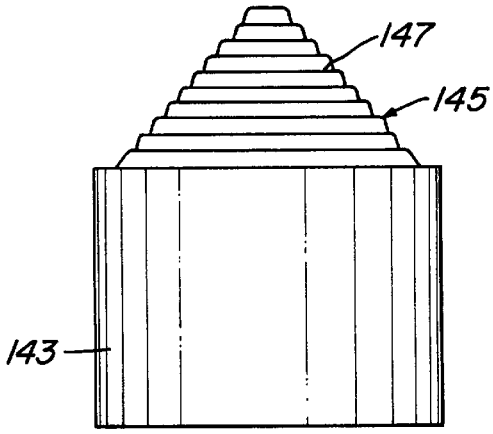
FIG. 15 is an elevation view of an eighth alternative embodiment of the present invention.

In FIG. 15, body 143 has a cutting end 145 that is conical. A top view would appear as shown in FIG. 14. Cutting end 145 has a plurality of grooves 147. As in the embodiment of FIGS. 13, grooves 147 could be of any one of the types shown in FIGS. 4–9. Moreover, depressions such as individual recesses 123 in FIG. 10A could be utilized.

The earth-boring bit according to the present invention possesses a number of advantages. A principal advantage is that the bit is provided with super-hard cutting elements that can withstand the rigors of drilling with rolling cutter bits yet are economically manufactured.

The invention has been described with reference to a preferred embodiment thereof. It is thus not limited but is susceptible to variation and modification without departing from the scope and spirit of the invention.

We claim:

1. An earth-boring bit comprising:

at least one cutting element support;

a plurality of cutting elements secured within holes formed in the cutting element support;

at least one of the cutting elements having:

a generally cylindrical body of hard metal, the body having a convex cutting end and a longitudinal axis;

a plurality of recesses formed in the cutting end of the body, each of the recesses being configured such that a line parallel to the longitudinal axis may extend from any point or each of the recesses without touching any other point on the same recess, to enable the cutting element body and the recesses to be formed simultaneously by conventional powder metallurgy techniques; and a layer of super-hard material formed on the cutting end of the body and engaging the recesses formed thereon.

2. The earth-boring bit according to claim 1, wherein each portion of each of the recesses forms a positive draft angle of at least seven degrees relative to the longitudinal axis.

3. The earth-boring bit according to claim 1, wherein the recesses comprise grooves formed in the body.

4. The earth-boring bit according to claim 1 wherein the hard metal is cemented tungsten carbide, and the super-hard material is polycrystalline diamond.

5. The earth-boring bit according to claim 1, wherein the recesses comprise grooves formed in the body which are parallel to each other and extend in directions perpendicular to the longitudinal axis.

6. The earth-boring bit according to claim 1, wherein the recesses comprise grooves formed in the body which are parallel to each other and extend in directions parallel to the longitudinal axis.

7. The earth-boring bit according to claim 1, wherein the recesses comprise separate spaced apart depressions formed in the body.

8. The earth-boring bit according to claim 1, wherein the recesses comprise parallel grooves which have crests and roots.

9. The earth-boring bit according to claim 1, wherein the recesses comprise parallel grooves which have crests and roots, each root and each crest being rounded.

10. The earth-boring bit according to claim 1, wherein the recesses comprise parallel grooves which have intersecting first and second flanks defining a sawtooth configuration, the flanks intersecting each other at an obtuse angle.

11. The earth-boring bit according to claim 1, wherein the recesses comprise parallel grooves which have intersecting first and second flanks defining a sawtooth configuration, the flanks intersecting each other at an acute angle.

12. The earth-boring bit according to claim 1, wherein the recesses comprise parallel grooves having roots and crests which form together in cross section a continuous curved surface, and wherein a line tangent to any point on the continuous curved surface will be at a draft angle of at least seven degrees positive relative to the longitudinal axis.

13. The earth-boring bit according to claim 1 wherein the cutting end is chisel-shaped, having a pair of flanks converging to define a crest, and a pair of ends connecting the flanks, each of the ends forming a rounded corner with the crest;

the crest of the body forming a curved line extending from one of the corners to the other of the corners, defining a midpoint of the crest which is located a distance farther from the base than a distance from each of the corners to the base.

14. An earth-boring bit comprising:

a cutting element support;

a plurality of cutting elements secured within holes formed in the cutting element support;

at least one of the cutting elements having:

a generally cylindrical body of hard metal, the body having a convex cutting end and a longitudinal axis;

a plurality of recesses formed in the cutting end of the body, each portion of each of the recesses forming a positive draft angle relative to the longitudinal axis to enable the body and the recesses to be formed simultaneously by conventional powder metallurgical techniques; and a layer of super-hard material formed on the cutting end of the body and engaging the recesses formed thereon.

15. The earth-boring bit according to claim 14, wherein the positive draft angle of each portion of each of the recesses is at least seven degrees relative to the longitudinal axis.

16. The earth-boring bit according to claim 14, wherein the recesses comprise parallel grooves formed in the body.

17. The earth-boring bit according to claim 14, wherein the recesses comprise separate spaced apart depressions formed in the body.

18. The earth-boring bit according to claim 14, wherein the recesses comprise parallel grooves which have crests and roots, each root and each crest being rounded.

19. The earth-boring bit according to claim 14, wherein the recesses comprise parallel grooves which have intersecting first and second flanks defining a sawtooth configuration, the slopes intersecting each other at an obtuse angle.

20. The earth-boring bit according to claim 14, wherein the recesses comprise parallel grooves which have intersecting first and second flanks defining a sawtooth configuration, the slopes intersecting each other at an acute angle.

21. The earth-boring bit according to claim 14 wherein the hard metal is cemented tungsten carbide, and the super-hard material is polycrystalline diamond.

22. An earth-boring bit comprising:

a bit body;

at least one cantilevered bearing shaft depending inwardly and downwardly from the bit body;

a cutter mounted for rotation on the bearing shaft;

a plurality of cutting elements secured within holes formed in the cutter;

at least one of the cutting elements having:

a generally cylindrical cutting element body of hard metal, the cutting element body having a base, a convex cutting end extending from the base and a longitudinal axis, the cutting end being chisel-shaped, having a pair of flanks converging to define a crest, and a pair of ends connecting the flanks, each of the ends forming a corner with the crest;

the crest of the body forming a curved line extending from one of the corners to the other of the corners, defining a midpoint of the crest which is located a distance farther from the base than a distance from each of the corners to the base;

a plurality of recesses formed in the flanks of the body, each portion of each of the recesses forming a positive draft angle relative to the longitudinal axis to enable the body and the recesses to be formed simultaneously by conventional powder metallurgical techniques; and a layer of super-hard material formed on the cutting end of the cutting element body and covering the flanks, crest, and ends of the cutting end, the portion of the super-hard material covering the crest being substantially uniform in thickness.

* * * * *

UNITED STATES PATENT AND TRADEMARK OFFICE

CERTIFICATE OF CORRECTION

PATENT NO. : 6,098,730
DATED : August 8, 2000
INVENTOR(S) : Danny E. Scott, et al It is certified that error appears in the above-identified patent and that said Letters Patent is hereby corrected as shown below:

Column 2, Line 20, delete "disclose" and insert --discloses--.

Column 5, Line 65, delete "causing" and insert --caused--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*